US005758610A

United States Patent [19]

Park

[11] Patent Number: 5,758,610

[45] Date of Patent: Jun. 2, 1998

[54] AIR COOLED SELF-SUPERCHARGING FOUR STROKE INTERNAL COMBUSTION ENGINE

[76] Inventor: Gile Jun Yang Park, 6715 Arcola Street, Burnaby, British Columbia, Canada, V5E 1H4

[21] Appl. No.: 747,396

[22] Filed: Nov. 12, 1996

[51] Int. Cl.[6] ..... F02B 75/06

[52] U.S. Cl. ..... 123/51 A; 123/52.4

[58] Field of Search ..... 123/51 R, 51 A, 123/51 AA, 52.2, 52.3, 52.4, 317

[56] References Cited

U.S. PATENT DOCUMENTS

| | | | |
|---|---|---|---|
| 968,127 | 8/1910 | Cloud | 123/52.4 |
| 1,135,943 | 4/1915 | Legan . | |
| 1,358,954 | 11/1920 | Holmstrom | 123/51 R |
| 1,457,322 | 6/1923 | Sproule . | |
| 1,892,635 | 12/1932 | Schwarz | 123/52.2 |
| 2,200,744 | 5/1940 | Heinzelmann | 60/13 |
| 2,596,410 | 5/1952 | Jordan | 123/90.31 |
| 3,073,293 | 1/1963 | Barker . | |
| 3,537,437 | 11/1970 | Paul | 123/192.1 |
| 3,581,628 | 6/1971 | Williams | 92/73 |
| 4,274,369 | 6/1981 | Rhoads | 123/51 A |
| 4,461,251 | 7/1984 | Sheaffer | 123/317 |
| 4,506,634 | 3/1985 | Kerrebrock | 123/52.3 |
| 4,779,601 | 10/1988 | Dallman | 123/572 |
| 4,854,274 | 8/1989 | Dingess | 123/52.3 |
| 5,347,967 | 9/1994 | Todero et al. | 123/317 |
| 5,429,101 | 7/1995 | Uebelhoer et al. | 123/572 |
| 5,479,907 | 1/1996 | Walker, Jr. | 123/573 |
| 5,542,402 | 8/1996 | Lee et al. | 123/573 |

*Primary Examiner*—David A. Okonsky
*Attorney, Agent, or Firm*—Oyen Wiggs Green & Mutala

[57] ABSTRACT

An air-cooled self-supercharging four stroke internal combustion engine having four pistons which move in unison. There are two downward piston strokes in each four stroke cycle. The downward strokes of the pistons are used to compress the air in the crank case and supercharge the engine by forcing more air and fuel into the two combustion chambers. Each combustion chamber serves two piston cylinders. The compressed air and fuel mixture is forced into only one combustion chamber during each downward stroke of the pistons. The two combustion chambers are charged with air and fuel on alternating downward piston strokes. The engine is air-cooled by the flow of the combustion intake air which passes through the crank case. At the same time, heat transferred from the engine pre-heats the intake air to improve combustion efficiency.

15 Claims, 6 Drawing Sheets

FIG. 1-A
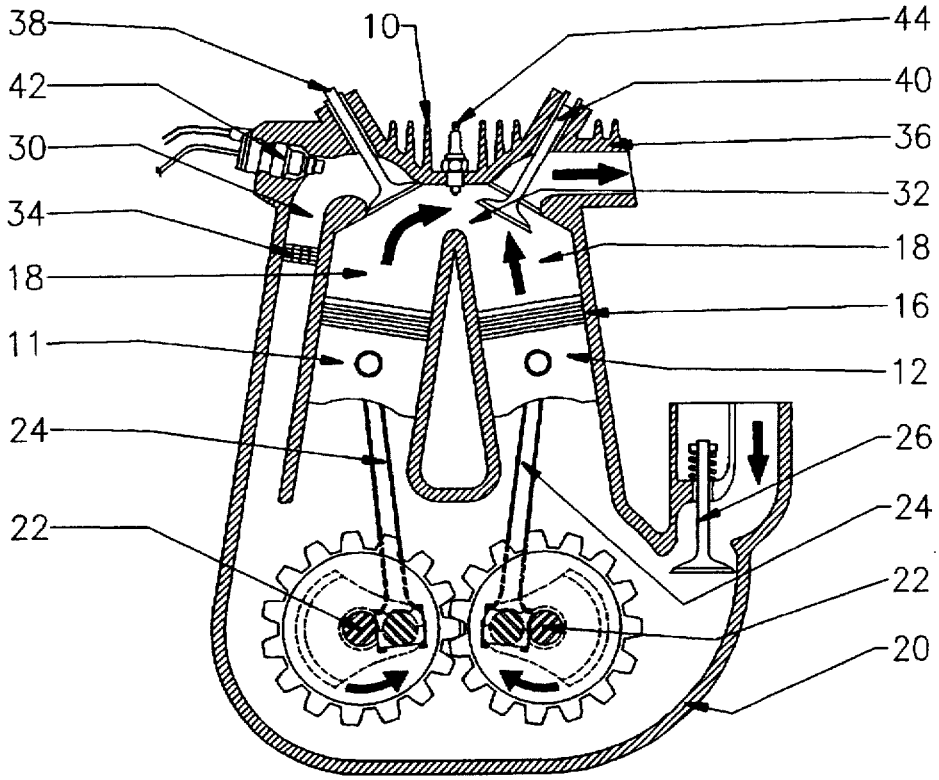
FIG. 1-B
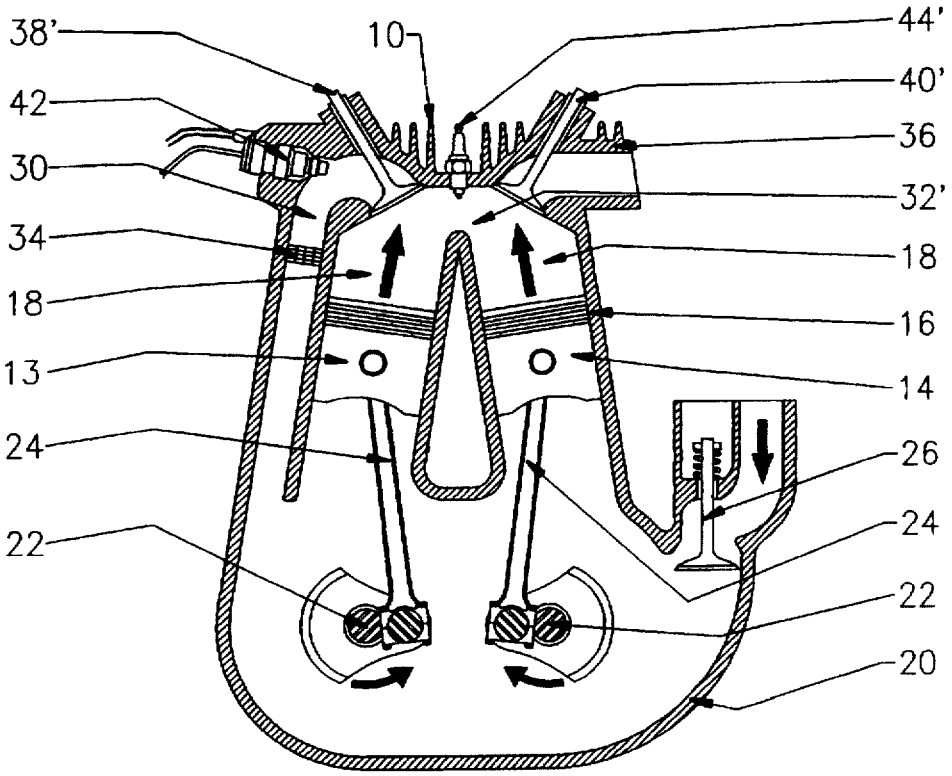

FIG. 2-A
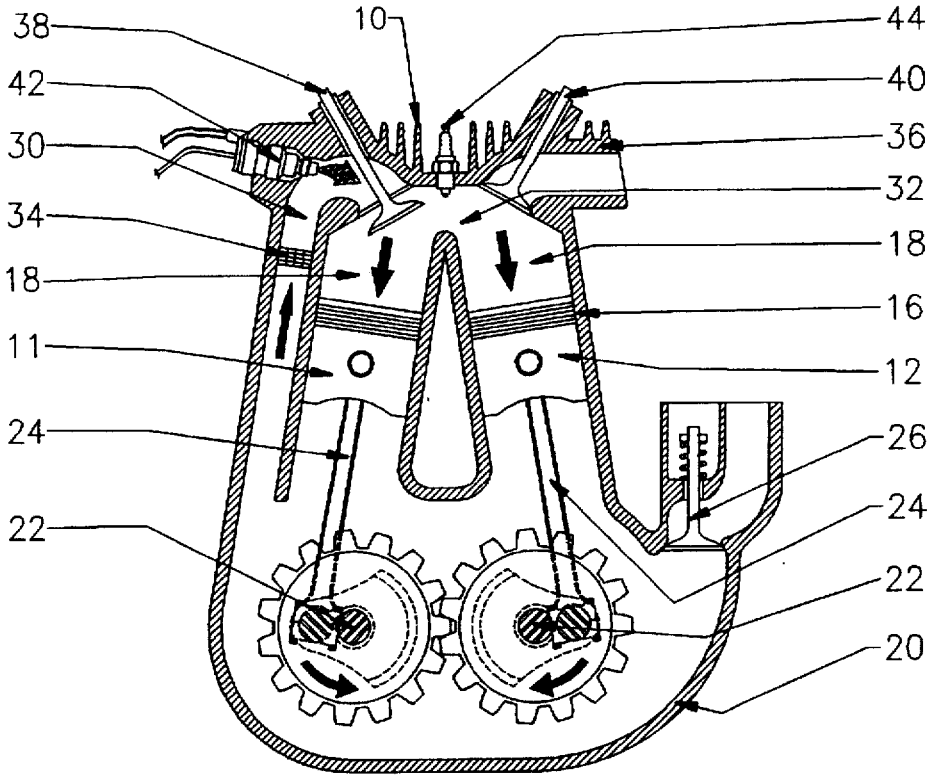
FIG. 2-B
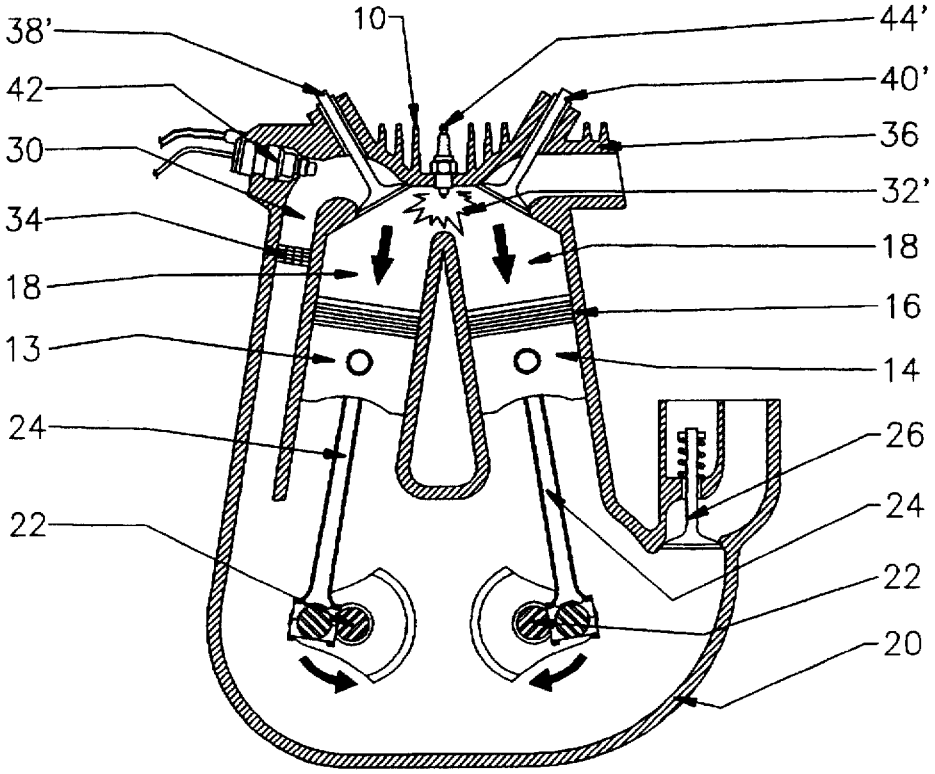

FIG. 3-A
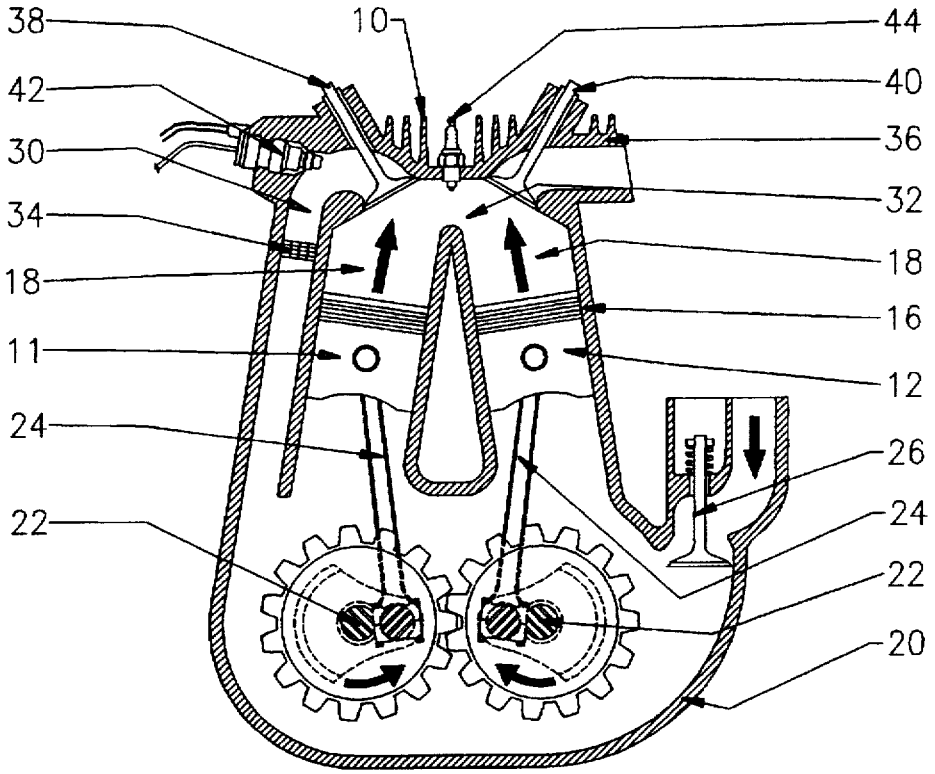
FIG. 3-B
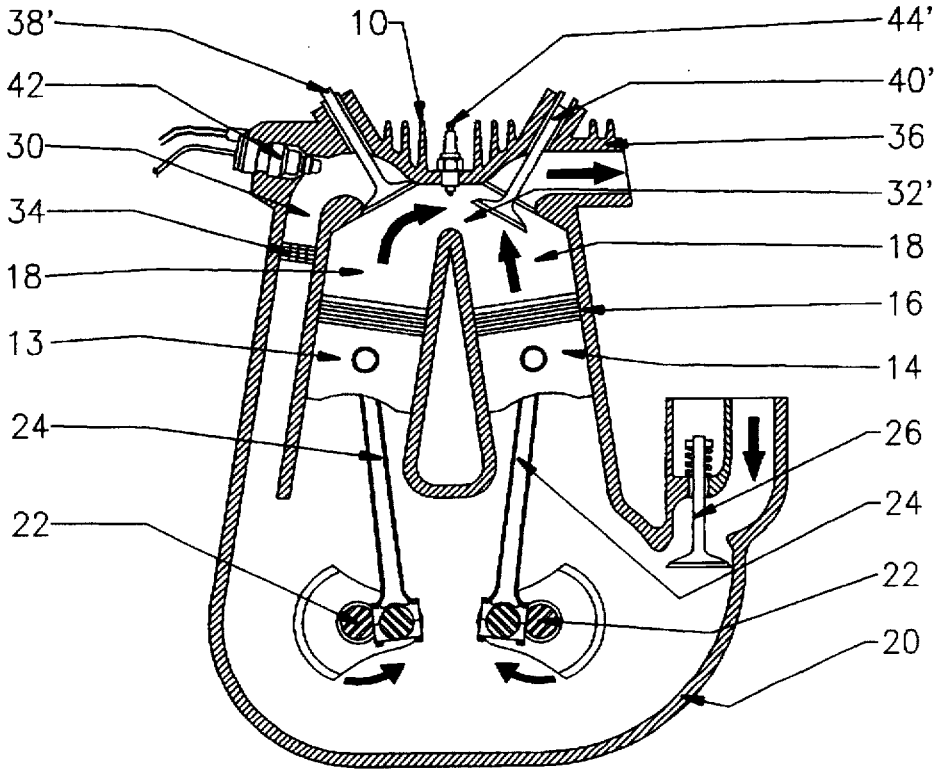

FIG. 4–A
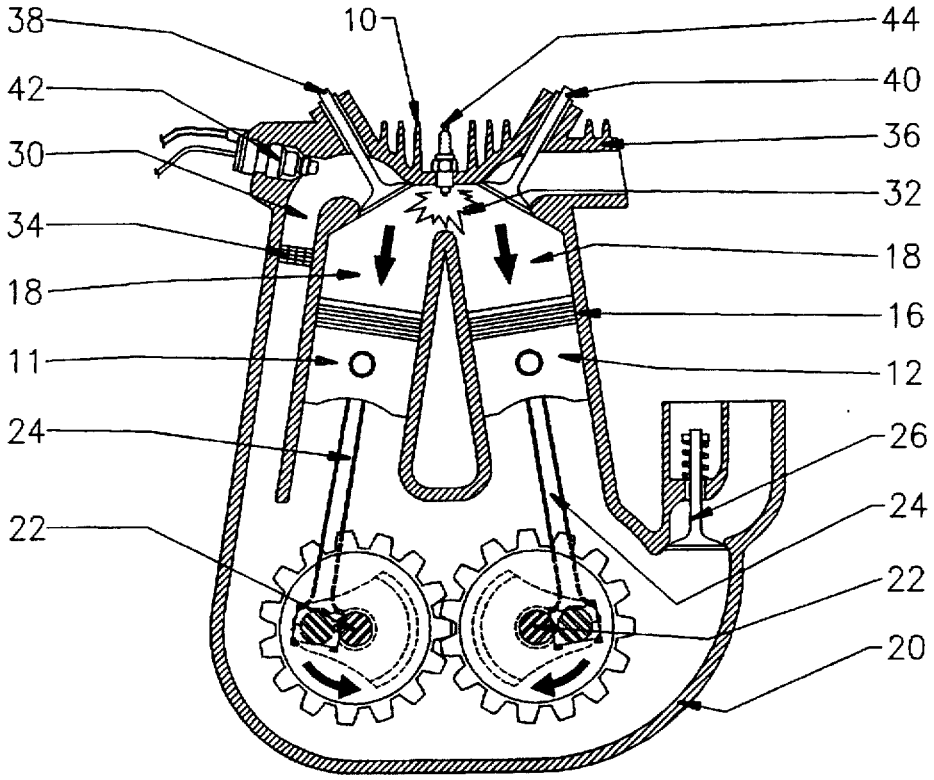
FIG. 4–B
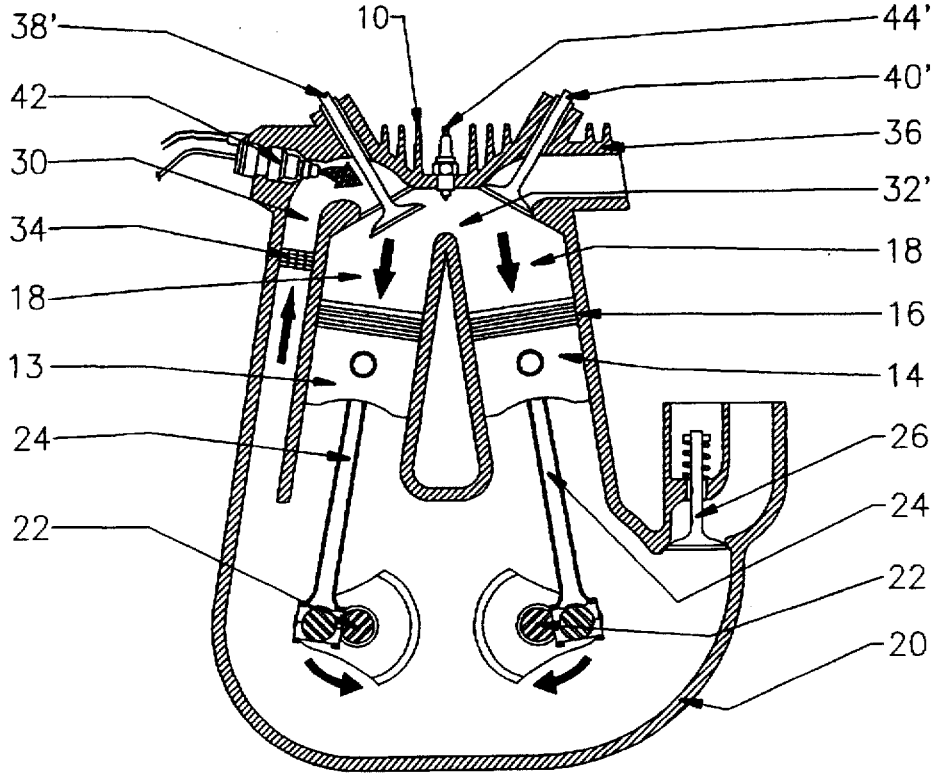

AIR COOLED SELF-SUPERCHARGING FOUR STROKE INTERNAL COMBUSTION ENGINE

FIELD OF THE INVENTION

The invention relates to a novel four stroke internal combustion engines, and more particularly to a dynamically balanced air-cooled self-supercharging engine which receives intake air for combustion through the crank case, where it is compressed by the pistons which move in unison.

BACKGROUND OF THE INVENTION

A conventional internal combustion piston engine has four piston strokes, namely an intake stroke, a compression stroke, a power stroke and an exhaust stroke. The intake stroke and the power stroke define the alternating downward strokes of each piston. The compression stroke and the exhaust stroke define the alternating upward piston strokes. During the power stroke, the piston is propelled downwards by the combustion of fuel in a combustion chamber above the piston. Each piston is attached to a crankshaft by a connecting rod and the downward motion of the piston during the power stroke applies a tangential force to the crankshaft which causes the crankshaft to rotate.

In a conventional multiple piston internal combustion engine, the power strokes of the pistons are staggered, as is the orientation of the attachment points on the crankshaft for the connecting rods. The staggered piston strokes apply a steady force to the crankshaft through each full rotation. Thus, when one piston is in an intake, compression, or exhaust stroke, another piston is in a power stroke. Because all of the pistons are connected to the crankshaft by the connecting rods, it is the rotation of the crankshaft which causes the pistons to move up and down through the exhaust, intake, and compression strokes. Therefore, while it is the power stroke which causes the crankshaft to rotate, it is the crankshaft which causes the pistons to move through the other three strokes in the four stroke cycle.

In a conventional internal combustion engine, the downward motion of a piston in its power or intake stroke is counterbalanced by the upward motion of another piston in its compression or exhaust stroke. The staggered piston movement prevents the movement of the pistons from causing air pressure fluctuations in the crank case.

However, other factors in the normal operation of a conventional internal combustion engine influence the air pressure in the crank case. In a conventional internal combustion engine the crank case needs to be vented to prevent the accumulation of "blow-by gas" and a corresponding build up of gas pressure. Blow-by gas is air and unspent fuel that leaks past the pistons and into the crank case during the power stroke. In a conventional engine, a venting system is used to prevent pressure from building in the crank case. Sometimes conventional venting systems recover the unspent fuel in the blow-by gas. This is known as "scavenging". Accordingly, there is a need to remove air and fuel that has escaped from the combustion chambers and piston cylinders during the power strokes.

In a conventional internal combustion engine, liquid-filled cooling systems are used to cool the engine. Conventional cooling systems recycle the cooling liquid. Hoses take the liquid to compartments next to the engine block so heat generated by the engine can be transferred to the liquid which is flowing through the compartments. The heated liquid is carried to a heat exchanger, typically a radiator, where external air is used to cool the liquid before returning it to the engine to be heated again. A pump is needed to keep the cooling fluid flowing through the system. This pump needs power to circulate the liquid and this power is provided by the internal combustion engine.

The components of a conventional liquid-filled cooling system and the liquid itself add considerable weight to a conventional engine It is well known that reducing the overall weight of a vehicle increases efficiency by reducing the amount of work that the engine must do. Accordingly, there is a need for an engine that uses a cooling system that is lighter than a conventional liquid-filled cooling system.

Conventional liquid cooling systems use outside air to cool the liquid. The cooled liquid is then used to cool the engine. The heat must be transferred from the engine through the metal which separates the combustion chambers from the "liquid jacket" compartment which holds the cooling liquid. Hoses carry the heated liquid to the radiator; where the heat must be transferred through the metal radiator casing to the cooler air. Cooling efficiency is reduced because outside air is used to indirectly cool the engine. Therefore, cooling efficiency could be improved if the cooling air was brought into direct contact with the hot engine components. Accordingly, there are advantages to using outside air to cool hot engine components by bringing the air into direct contact with hot engine components.

In a conventional internal combustion engine, engine wear is reduced and operational efficiency is improved if engine vibration is minimized. Vibration can be eliminated in an engine that is dynamically balanced. It is difficult to dynamically balance a conventional engine which has only one crankshaft and four, six or eight pistons firing in sequence. Accordingly, there is a need for an engine that is more dynamically balanced and more efficient than a conventional engine.

In a conventional internal combustion engine, the speed of the engine is measured in rotations per minute ("r.p.m.") of the crankshaft. Operating an engine at higher r.p.m. means that the pistons go through more cycles and all of the moving engine parts go through more operating cycles. Conventional internal combustion engines that are not dynamically balanced need to operate at higher r.p.m. to achieve power balancing. Therefore, an engine must be dynamically balanced to operate smoothly at a lower r.p.m. Operating at a lower r.p.m. results in less engine wear because less operating cycles are performed compared to an engine doing the same work operating at a higher r.p.m. An engine which operates with a longer piston stroke, operates at a slower speed, with increased power and with better fuel economy. Therefore, there is a need for an engine which operates at lower r.p.m. by using longer piston strokes.

There are a number of patents which disclose dynamically balanced internal combustion engines. Some examples of patents which disclose matched counter-rotating crankshafts are U.S. Pat. No. 2,200,744 granted to Heinzelmann ("Heinzelmann"), U.S. Pat. No. 2,596,410 granted to Le Grand L. Jordan ("Jordan"), U.S. Pat. No. 3,537,437 granted to Angelo Marius Paul ("Paul"), and U.S. Pat. No. 3,581,628 granted to Thomas V. Williams ("Williams"). None of these patents disclose a four stroke engine where four pistons move up and down in unison. None of these patents disclose routing the intake combustion air through the crank case thereby compressing the intake air to supercharge the engine, cooling the engine, pre-heating the intake air, venting the crank case, and minimizing pollution by recovering unspent fuel lost from the piston cylinders during power strokes.

Another problem with conventional internal combustion engines relates to the fuel supply system. In a conventional engine, when the ignition is shut off, the engine continues to run for a few piston strokes and thus the fuel injection system does not immediately shut off. Some fuel continues to be injected into the engine after the fuel ignition system is shut down. The unburned fuel may evaporate and escape from the combustion chambers to the outside environment, thereby causing pollution. This represents a loss in fuel. Accordingly, there is a need to prevent unburned fuel from being left in the combustion chambers and piston cylinders after the engine ignition has been switched off.

SUMMARY OF THE INVENTION

The invention relates to a four stroke air cooled self-supercharging internal combustion engine comprising an engine block with four piston cylinders, wherein said piston cylinders are arranged in first and second side-by-side pairs with each pair straddling a longitudinal axis of the engine block. One piston is positioned in each piston cylinder and the pistons are synchronized to move up and down in unison. The invention also encompasses an improved fuel supply system.

Each pair of pistons has one combustion chamber which covers both piston cylinders. The combustion chamber has a bottom which is open to the two piston cylinders. The volume of the combustion chamber is bound by the tops of the pistons, the walls of the piston cylinder above the piston tops, and a cylinder head joined to the top of the engine block.

A crank case is joined to the bottom of the engine block. Two dynamically balanced crankshafts are mounted in the crank case with parallel axes aligned with the longitudinal axis of the engine block. The crankshafts are geared to each other for synchronized counter-rotation by inter-locking teeth on gears mounted on said crankshafts. The crankshafts and pistons are weighted to be dynamically balanced to reduce engine vibration.

Compared to conventional unbalanced engines, because the engine according to the invention is dynamically balanced, the engine can use longer piston strokes and operate smoothly at a lower r.p.m.

Connecting rods connect the pistons to the crankshafts such that the downward movement of the pistons applies a tangential force to the crankshaft, thereby causing the crankshaft to rotate. The connecting rods on each side of the engine's longitudinal axis are connected to the crankshaft at the same orientation, since the pistons move in unison.

The intake air used for combustion is routed through the crank case before being directed to the combustion chamber. An intake port is located on a wall of the crank case for admitting fresh intake air into the crank case. An exit port is also located on a wall of the crank case for withdrawing air from the crank case. An air manifold is connected at one end to the crank case and at the opposite end to the combustion chambers.

An oil separator can be installed in the air manifold to prevent crank case oil from being carried to the combustion chambers with the intake air.

The intake air is cooler than the hot engine components so the air provides a cooling effect to the engine components inside the crank case and engine block. This cooling effect can be combined with other air cooling features such as fins on the exterior surfaces of the engine to thereby eliminate the need for a separate liquid-filled cooling system. Eliminating the liquid-filled cooling system results in a reduction of the overall weight of the engine and improving overall efficiency.

The heat transferred from the engine components to the air pre-heats the intake air which improves combustion efficiency.

The downward motion of the pistons has the effect of compressing the intake air in the crank case. The upward motion of the pistons produces a vacuum effect that helps to draw fresh intake air into the crank case. Valves are used to coordinate drawing fresh air into the crank case with the upward piston strokes and withdrawing compressed crank case air with the downward piston strokes.

A crank case valve mounted in an intake port in the crank case is open when the pistons are moving upwards, expanding the volume of the crank case. The vacuum created by the expanding volume encourages intake air to be drawn into the crank case through the crank case valve.

During the downward motion of the pistons, the crank case valve is closed. The downward motion of the pistons compresses the air in the crank case and pushes air out of the crank case, through the air manifold, to the intake valves and into one of the combustion chambers.

The compression effect caused by the synchronized downward stroke of the four pistons compresses the crank case air. The engine has only two combustion chambers for the four pistons. Each combustion chamber serves two pistons. According to the invention, intake valves are used to direct the compressed combustion air to only one of the combustion chambers during each downward piston stroke. Because four pistons have compressed the intake air which is forced into one combustion chamber serving two piston cylinders, a compression effect is realized in the combustion chamber. When pressure is used to increase the amount of air and fuel forced into a combustion chamber, this is known as "supercharging". The compression of air in the crank case thereby produces a supercharging effect by forcing extra air and fuel into the combustion chamber.

Exhaust valves are used to control the venting of combustion products from the combustion chamber and piston cylinders. During the exhaust stroke the exhaust valve is open to vent combustion products from the piston and combustion chambers. The upward movement of the piston during the exhaust stroke helps to push the combustion products out through the exhaust valve.

The intake and exhaust valves are both closed to seal the combustion chamber during the compression and power strokes. The exhaust valve is also closed during the intake stroke to prevent air and fuel that is being drawn into the combustion chamber from being prematurely exhausted.

The intake valves are closed during the exhaust stroke to prevent combustion products from being mixed with intake air and fuel in the air manifold.

An additional benefit of the invention is that since the intake air used for combustion is routed through the crank case, the crank case does not need to be vented. The engine, according to the invention, does not require separate crank case venting and scavenging systems. Unspent fuel and air is automatically recycled back to the intake air flow and pressure does not build up since the crankcase air pressure is continuously relieved with each downward stroke of the pistons.

The engine according to the invention also has an improved fuel supply system. Fuel supply and ignition is controlled by the engine ignition switch. Turning the engine off immediately stops the fuel injectors from injecting any more fuel.

Fuel ignition continues until there is no more fuel in the combustion chambers and piston cylinders. Fuel ignition is controlled by an electrical circuit that is connected directly to the battery. The electrical current is controlled by a switch that is closed to complete the circuit when the oil pressure is above the minimum operating oil pressure. Once all of the fuel remaining in the engine is burned, the engine stops, oil pressure decreases, and the fuel ignition switch disconnects the circuit stopping electrical current from going to the fuel ignition system.

BRIEF DESCRIPTION OF THE DRAWINGS

FIGS. 1A, 2A, 3A and 4A are front cross-sectional views cut through two piston cylinders of an air cooled self-supercharging internal combustion engine according to the invention during the exhaust stroke, intake stroke, compression stroke, and power stroke, respectively;

FIGS. 1B, 2B, 3B and 4B are front cross-sectional views cut through two piston cylinders of an air cooled self-supercharging internal combustion engine according to the invention during the compression stroke, power stroke, exhaust stroke, and intake stroke, respectively;

DETAILED DESCRIPTION OF THE PREFERRED EMBODIMENT

Figure 5:
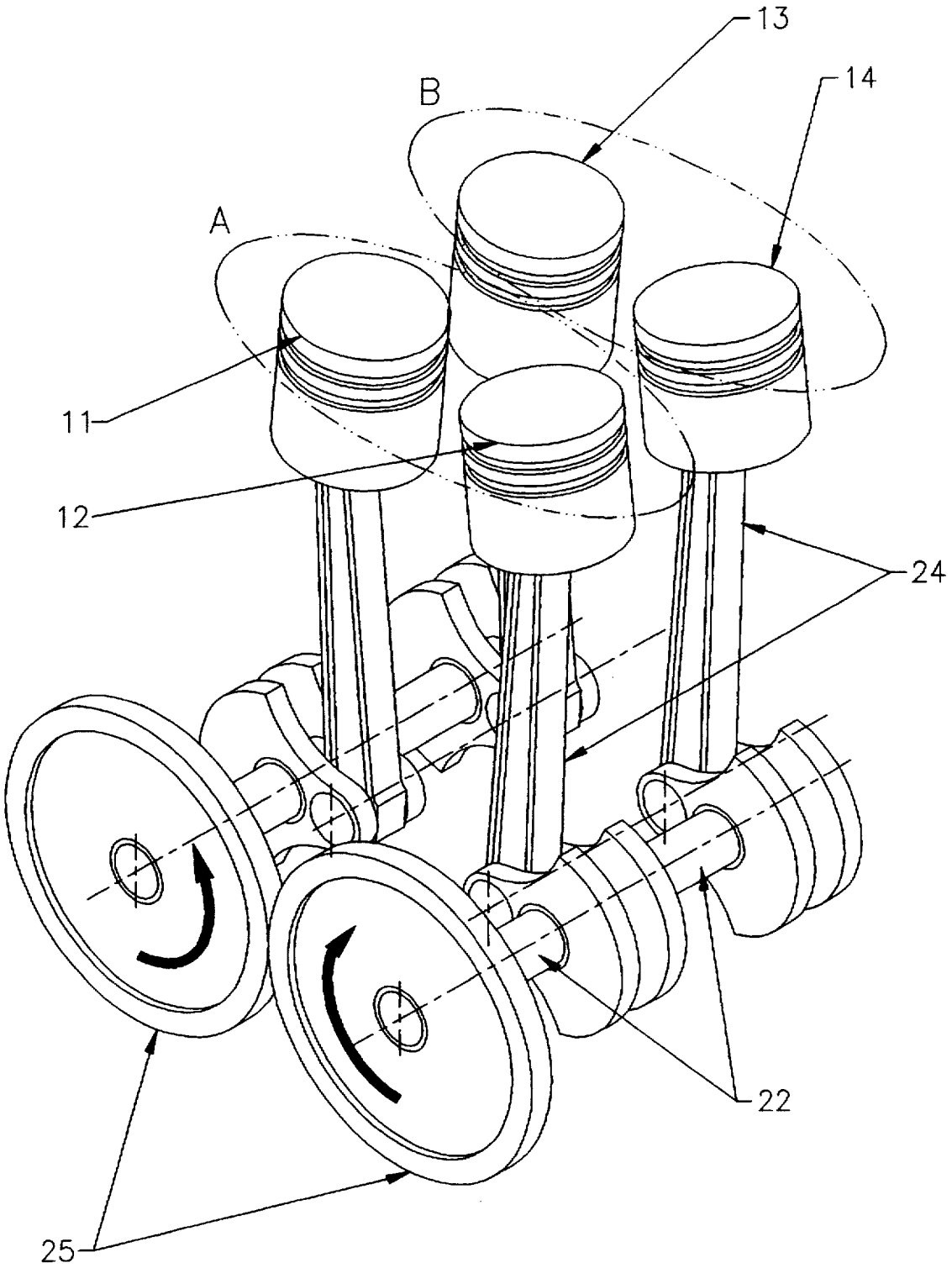
FIG. 5 is a schematic diagram depicting four pistons attached by respective connecting rods to two crankshafts according to the invention.

The invention relates to a four stroke internal combustion engine (10) with four pistons arranged in side-by-side pairs. The four piston strokes repeat themselves in the following sequential order: exhaust stroke, intake stroke, compression stroke, and power stroke. The intake and power stroke correspond to downward piston motions, while the compression and exhaust strokes correspond to upwards piston motions. All four pistons are identical in size, position and stroke, and the pistons move up and down in unison.

FIG. 1A illustrates a front cross-sectional view through the engine (10), showing one pair of pistons (11, 12). The two pistons (11, 12) are positioned inside the engine block (16) in two piston cylinders (18). A crank case (20) is mounted on the bottom of the engine block (16). The crank case (20) houses two crankshafts (22) with parallel axes in the direction of the longitudinal axis of the engine block (16). The pair of crankshafts (22) have interlocking gears to assist with the synchronization of the pistons (11, 12). Two connecting rods (24) connect the pair of pistons (11, 12) to the crankshafts (22). FIG. 1A shows how the piston (11), connecting rod (24), and crankshaft (22) on one side of the engine's longitudinal axis are a mirror image of the piston (12), connecting rod (24), and crankshaft (22) on the opposite side of the engine's longitudinal axis.

FIG. 5 shows two pistons on each side of the longitudinal axis of the engine (10). The connecting rods (24) attached to pistons (11, 13) on one side of the engine's longitudinal axis are attached to the crankshaft (22) at the same orientation. Similarly, the connecting rods (24) attached to pistons (12, 14) on the other side of the engine's longitudinal axis are attached to the crankshaft (22) at the same orientation, which is a mirror image of the connecting rods (24) and crankshaft (22) of the opposing pistons (11, 13).

Referring again to FIG. 1A, the flow of air, fuel and combustion gases through the body of the engine (10) is regulated by valves (26, 38, 40). The crank case (20) has a crank case valve (26) for controlling the entrance of air into the crank case (20) during the upward piston strokes. In the preferred embodiment, crank case valve (26) is a reed valve. An intake valve (38) controls the withdrawal of air from the air manifold (30) and crank case (20) during the downward piston strokes. Air that has been admitted into the body of the engine (10) and through the crank case valve (26) and the crank case (20), is brought via an air manifold (30) to a combustion chamber (32) above the pair of piston cylinders (18). An oil separator (34) in the air manifold (30) separates oil from the air and returns the oil to the crank case (20).

As shown in FIG. 1A, the combustion chamber (32) is a compartment on top of the piston cylinders (18), above the pair of pistons (11, 12). The cylinder head (36) forms the top cover of the combustion chamber (32). There is a separate combustion chamber (32) for each pair of pistons (11, 12) and (13, 14). Each combustion chamber (32) has an intake valve (38) which controls the flow of air, or an air and fuel mixture, into the combustion chamber (32) during the intake stroke. An exhaust valve (40) controls the withdrawal of exhaust gases from the combustion chamber (32) after combustion during the exhaust stroke.

FIGS. 1A through 4B depict an engine (10) fuelled by gasoline. During the intake stroke, fuel is injected into the air manifold (30) through a fuel injector (42). The fuel mixes with the combustion air producing a mixture of fuel and air.

The fuel and air mixture is drawn into the combustion chamber (32) through the open intake valve (38). The exhaust valve (40) is closed during the intake stroke to prevent the fresh combustion air and injected fuel from escaping from the combustion chamber (32).

FIG. 1A depicts a pair of pistons (11, 12) at the beginning of the exhaust stroke. In FIG. 1A the pistons (11, 12) have just completed the power stroke so they have finished their downward motion. The pistons (11, 12) are now just beginning to rise upwards in the piston cylinders (18).

Intake air for combustion is drawn into the crank case (20) through the open crank case valve (26) on the side wall of the crank case (20). The upward motion of the pistons (11, 12) helps to draw the intake air into the crank case (20). The exhaust valve (40) mounted on top of the combustion chamber (32) is open. As the pistons (11, 12) rise in the piston cylinders (18) exhaust combustion gases are pushed out of the combustion chamber (32) through the open exhaust valve (40). During the exhaust stroke the intake valve (38) is closed.

FIG. 2A shows the pair of pistons (11, 12) during the fuel and air intake stroke, which follows sequentially after the exhaust stroke shown in FIG. 1A. The pistons (11, 12) have already travelled to the top of their stroke and they are now moving downwards. Crank case valve (26) is closed during the intake stroke. The downwards motion of the pistons (11, 12) pushes the air in the crank case (20) into the air manifold (30).

FIG. 3A depicts the pair of pistons (11, 12) near the middle of the compression stroke, which follows sequentially after the intake stroke. The pistons (11, 12) are moving upwards during this stroke. The crank case valve (26) is open during the compression stroke and the upward motion of the pistons (11, 12) helps to draw air into the crank case (20). The intake valve (38) is closed to prevent air in the air manifold (30) from being drawn back into the crank case (20).

The intake valve (38) and the exhaust valve (40) are both closed. The upward motion of the pistons (11, 12) compresses the fuel and air mixture into the combustion chamber (32) at the top of the two piston cylinders (18).

FIG. 4A depicts the pistons (11, 12) near the end of the power stroke. At the beginning of the power stroke, the compression stroke has just been completed. The pistons (11, 12) are near the top of the piston cylinders (18) and the maximum compression has been attained by the pistons (11, 12) being at their uppermost position. The beginning of the power stroke is coordinated with the ignition of the fuel. FIG. 4A shows a spark plug (44) which produces a spark to ignite the fuel. The burning fuel produces combustion gases which expand to raise the pressure in the combustion chamber (32) above the pistons (11, 12). The high pressure in the combustion chamber (32) pushes the pistons (11, 12) downward.

As in the intake stroke, the downward motion of the pistons (11, 12) during the power stroke is used to compress the air in the crank case (20) thereby pushing the air into the air manifold (30) and through one of the intake valves (38) and into one of the combustion chambers (32). The intake valve (38) and exhaust valve (40) above pistons (11, 12) are both closed. However, the intake valve (38) above adjacent pistons (13, 14) is open.

All four pistons (11, 12, 13, 14) move in unison. FIGS. 1A, 2A, 3A and 4A have been used to describe the four stroke cycle with reference to the pair of pistons in group A (11, 12). The four strokes of the pair of pistons in group A (11, 12) are the same as the four strokes of the pair of pistons in group B (13, 14), however, the stroke cycle for the pistons in groups A and B are offset from one another by two strokes. FIGS. 1B, 2B, 3B and 4B illustrate the strokes for the pistons (13, 14) in group B that correspond to the strokes for the pistons in group A shown in FIGS. 1A, 2A, 3A, and 4A respectively. That is, when the pair of pistons in group A (11, 12) are in their power stroke as shown in FIG. 4A, the pair of pistons in group B (13, 14) are in their intake stroke as shown in FIG. 4B.

The four piston engine (10) according to the invention has two combustion chambers (32, 32'). As shown in FIGS. 1A, 2A, 3A, and 4A, combustion chamber (32) is positioned above the pair of pistons in group A (11, 12). As shown in FIGS. 1B, 2B, 3B, and 4B, combustion chamber (32') is positioned above the pair of pistons in group B (13, 14). The combustion chamber (32') has a intake valve (38') and an exhaust valve (40') that operate independently from the corresponding valves for the combustion chamber (32). The same crank case (20) is shared by all pistons (11, 12, 13, 14). The crank case valve (26), air manifold (30), and fuel injector (42) can also be shared by all pistons (11, 12, 13, 14).

FIG. 5 is a schematic diagram of the four pistons (11, 12, 13, 14). According to the invention, all four pistons (11, 12, 13, 14) are synchronized to move up and down together, however, the pair of pistons in group A (11, 12) operate on a stroke cycle that is staggered two strokes from the pair of pistons in the group B (13, 14). Consequently, when the pistons (11, 12) in group A are undergoing an upwards exhaust stroke, the pistons (13, 14) in group B are undergoing an upwards compression stroke, and vice versa. Similarly, when the pistons (11, 12) in group A are undergoing a downwards intake stroke, the pistons (13, 14) in group B are undergoing a downwards power stroke, and vice versa.

As described above, there are two downward strokes during the four stroke cycle. Only one downward stroke is needed to force an air and fuel mixture into one of the combustion chambers (32, 32'). According to the invention, the downward strokes are used to charge the two combustion chambers (32, 32') in alternating fashion since the two pistons (11, 12) in group A are operating on a four stroke cycle that is staggered by two strokes from the four stroke cycle for the pistons (13, 14) in group B. A benefit of this arrangement is that the downwards motion of the four pistons (11, 12, 13, 14) during one downward stroke is compressing air that is being pushed into two piston cylinders (18). In this way the engine (10), according to the invention, uses the motion of the pistons (11, 12, 13, 14) to produce a self-supercharging effect.

While the FIGS. 1A through 4B depict a gasoline powered engine (10), many of the same advantages can be realized for internal combustion engines using fuel other than gasoline. For example, for an engine using diesel as fuel, the fuel is injected directly into the combustion chamber (32) through an injector that could be positioned where the spark plug (44) is shown in the Figures. According to the invention, as with the gasoline powered engine (10), the diesel powered engine will also route the intake air through the crank case (20) and all of the pistons (11, 12, 13, 14) will be moving in unison. The downward strokes of the pistons (11, 12, 13, 14) will compress the air in the crank case (20) thus self-supercharging the engine (10).

Figure 6:
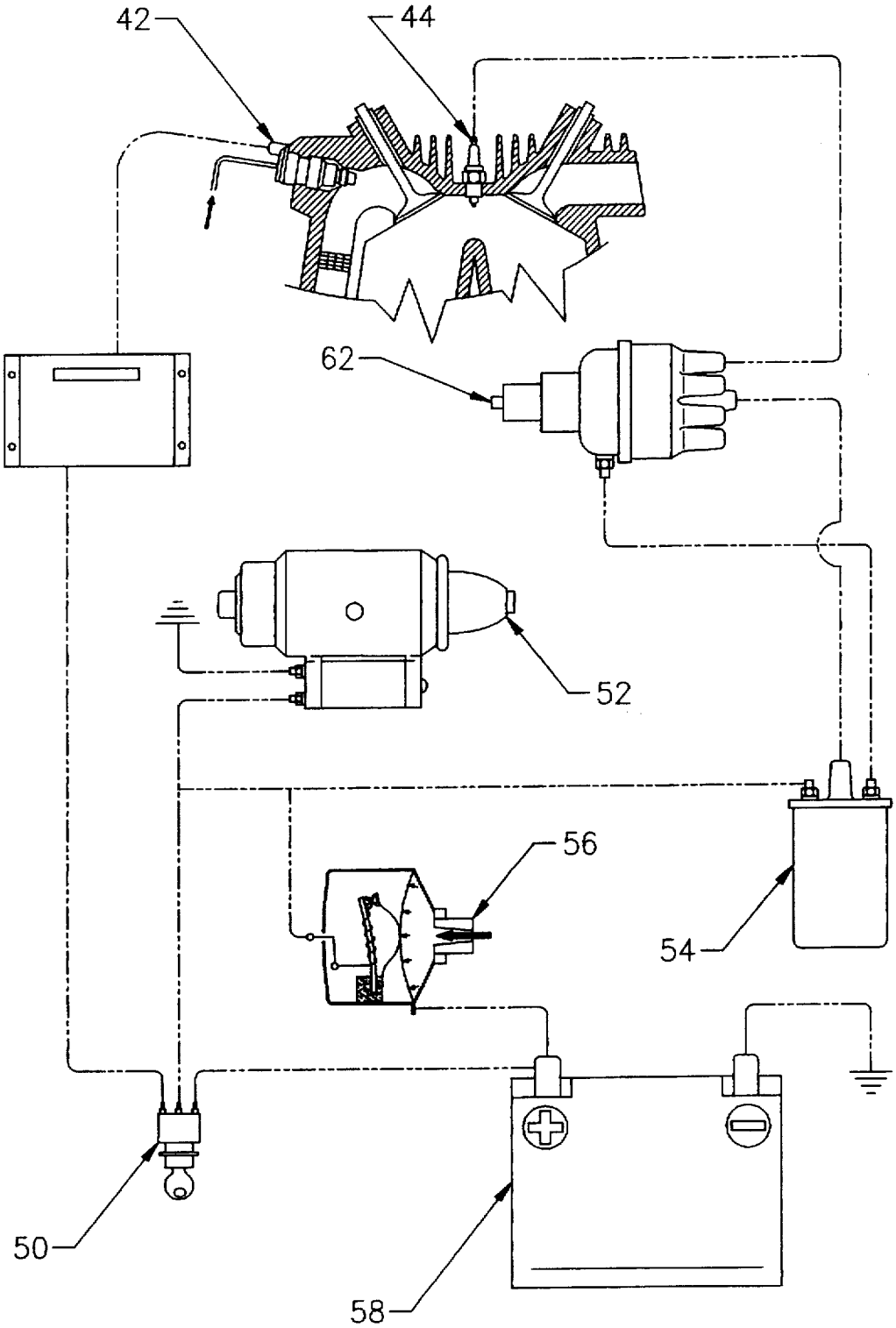
FIG. 6 is a schematic diagram depicting the ignition system according to the invention.

FIG. 6 is a schematic diagram depicting an ignition system which controls the fuel supply to the combustion chambers (32, 32'). To start the engine (10), the engine ignition switch (50) is turned to a "start position"; this sends an electrical current to the starter motor (52), the ignition coil (54) and the fuel injection system. The starter motor (52) turns the crankshafts (22) and the ignition coil (54) controls the ignition of the distributor (62) and sparkplug (44) which ignites the fuel and air mixture. Fuel is injected into the combustion chambers (32, 32') or into the intake air which is forced into the combustion chamber (32, 32'). Combustion starts and the engine ignition switch (50) is turned to the "on position".

Once the engine (10) is running no electrical current is sent to the starter motor (52). The running engine (10) immediately raises the oil pressure. A fuel ignition switch (56) activated by oil pressure completes a circuit to send electricity to the ignition coil (54). If the oil pressure is less than a pre-determined operating range, the fuel ignition switch (56) will not complete the circuit and the engine (10) will not start. According to the invention, the fuel ignition switch (56) prevents the engine (10) from starting and running when the oil pressure is too low. Operating an engine (10) when there is no oil or when oil pressure is too low can destroy the main components of the engine (10). Therefore, the ignition system according to the invention prevents the engine (10) from running when the oil pressure is too low.

In the preferred embodiment, the engine (10) will have a warning indicator to advise the driver when the engine (10) should be stopped and/or serviced if the oil pressure is near the low pressure limit. The warning indicator will warn the driver in the case where the oil pressure is adequate for starting the engine (10), but oil pressure is decreasing during the operation of the engine (10).

When the engine (10) is running and the driver wants to turn off the engine (10), the engine ignition switch (50) is turned to the "off position". According to the invention, this immediately stops the fuel injector (42) from injecting any further fuel into the engine (10). At the same time, since the fuel ignition switch (56) is directly connected to the battery (58) the fuel continues to be ignited so long as there is fuel in the combustion chambers (32). Thus, any fuel remaining in the combustion chambers (32) after the engine ignition switch (50) is turned off will be burned instead of being released to the atmosphere and polluting the environment.

In the preferred embodiment, engine weight can be reduced by eliminating components of a conventional engine that are made redundant by the invention. For example, the invention eliminates the need for a liquid-filled cooling system, including the radiator, the radiator fan, the water pump, the connecting hoses, and the water jacket for the engine block (16). Similarly, the invention eliminates the need for a separate air compressor for supercharging, and a separate scavenging system for recovering fuel from crank case gases.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A four stroke internal combustion engine comprising:

an engine block with four piston cylinders, wherein said piston cylinders are arranged in first and second side-by-side pairs with each said pair straddling a longitudinal axis of said engine block;

a first combustion chamber associated with said engine block and extending laterally to said longitudinal axis; said first combustion chamber being open to a first one of the pair of piston cylinders in the first side-by-side pair, and a first one of the pair of piston cylinders in the second side-by-side pair;

a second combustion chamber associated with said engine block and extending laterally to said longitudinal axis; said second combustion chamber being open to a second one of the pair of piston cylinders in the first side-by-side pair of piston cylinders and a second one of the pair of piston cylinders in the second side-by-side pair;

a crank case associated with said engine block below said piston cylinders;

four pistons with one piston in each of said piston cylinders, said pistons synchronized to move up and down in unison; and draw four cylinder volumes of intake air into the engine;

a first intake valve associated with the first combustion chamber;

a second intake valve associated with the second combustion chamber;

a first exhaust valve associated with the first combustion chamber;

a second exhaust valve associated with the second combustion chamber; and wherein on consecutive piston upstroke, said first and second intake valves alternate in charging said respective first and second combustion chambers with intake air, and on consecutive piston downstrokes, said first and second exhaust valves alternate in exhausting gases from said respective first and second combustion chambers, thereby providing a 2:1 compression to the intake air alternatively charging the first and second combustion chambers.

2. The four stoke internal combustion engine of claim 1 further comprising an air intake system, said system comprising:

an intake port associated with said crank case for drawing intake air into said crank case;

an exit port associated with said crank case for withdrawing air from said crank case;

an air manifold connected at a first end to said crank case and at a second end to said first and second combustion chambers, for directing air from said crank case to said alternating first and second combustion chambers, thereby routing said intake air through said crank case and providing an air cooling effect to said engine while simultaneously preheating said intake air.

3. The four stroke internal combustion engine of claim 1 wherein the two piston cylinders comprising the first side-by-side pair are slanted towards the two piston cylinders comprising the second side-by-side pair.

4. The four stroke internal combustion engine of claim 2 further comprising a crank case valve mounted in said intake port for controlling air flow into said crank case, wherein said crank case valve is open when said pistons are moving upwards and said crank case valve is closed when said pistons are moving downwards.

5. The four stroke internal combustion engine of claim 4 further comprising:

a first intake valve associated with a first combustion chamber intake port between said air manifold and said first combustion chamber;

a second intake valve associated with a second combustion chamber intake port between said air manifold and said second combustion chamber;

a first exhaust valve associated with a first exhaust port in said first combustion chamber; and a second exhaust valve associated with a second exhaust port in said second combustion chamber, wherein said first and second intake valves alternate in charging said combustion chambers on consecutive downstrokes and said first and second exhaust valves withdraw exhaust gases from their respective combustion chambers on alternating upward strokes of said pistons.

6. The four stroke internal combustion engine of claim 2 further comprising:

two crankshafts mounted in said crank case with parallel axes aligned with said longitudinal axis of said engine block, wherein said crankshafts are geared to each other for synchronized counter-rotation by inter-locking teeth on the gears mounted on said crankshafts; and rods connecting said pistons to said crankshafts whereby the unitary upward and downward movement of the pistons causes said crankshafts to rotate.

7. The four stroke internal combustion engine of claim 6 wherein said counter-rotating crankshafts are weighted to counterbalance dynamic forces of said crankshafts and dynamic forces caused by reciprocal motion of the pistons.

8. The four stroke internal combustion engine of claim 2 further comprising an oil separator located in said air manifold between said crank case and said combustion chambers.

9. The four stroke internal combustion engine of claim 5 wherein an air supercharging effect is achieved by using said four pistons to compress said fresh air in said crank case, before said air is directed to one of said combustion chambers serving two of said pistons.

10. The four stroke internal combustion engine of claim 2 further comprising a fuel injector associated with said air manifold for injecting fuel into compressed air in said air manifold where said fuel and compressed air mix before being forced into one of said combustion chambers.

11. The four stroke internal combustion engine of claim 1 further comprising an engine ignition switch which controls a fuel line which supplies fuel to said first and second combustion chambers, wherein turning said engine ignition switch to an off position simultaneously stops fuel injectors from injecting any more fuel.

12. The four stroke internal combustion engine of claim 11 further comprising a fuel ignition switch for controlling fuel ignition in said combustion chambers, said switch operating independently from said engine ignition switch, whereby after said ignition switch is turned off, said fuel ignition switch continues to allow fuel ignition so long as there is fuel in said combustion chambers.

13. The four stroke internal combustion engine of claim 12 wherein said fuel ignition switch is controlled by engine oil pressure, thereby preventing said engine from running when said engine oil pressure is too low.

14. The four stroke internal combustion engine of claim 1 further comprising:

a first fuel injector mounted on top of said first combustion chamber for injecting fuel directly into said first combustion chamber; and a second fuel injector mounted on top of said second combustion chamber for injecting fuel directly into said second combustion chamber.

15. The four stroke internal combustion engine of claim 1 wherein said four piston engine block forms a module and a plurality of such modules can be mounted on two crankshafts shared by all of said modules.

* * * * *